US006874194B1

(12) United States Patent
Harris

(10) Patent No.: US 6,874,194 B1
(45) Date of Patent: Apr. 5, 2005

(54) SAFETY FINGERTIP TOOTHBRUSH

(76) Inventor: Gerome C. Harris, P.O. Box 589, Luling, LA (US) 70070

( * ) Notice: Subject to any disclaimer, the term of this patent is extended or adjusted under 35 U.S.C. 154(b) by 314 days.

(21) Appl. No.: 10/202,751

(22) Filed: Jul. 25, 2002

(51) Int. Cl.[7] ..... A46B 5/04
(52) U.S. Cl. ..... 15/227; 15/167.1
(58) Field of Search ..... 15/167.1, 227; 2/21; 132/309, 323

(56) References Cited

U.S. PATENT DOCUMENTS 1,200,596 A * 10/1916 Daly ..... 15/227
2,318,365 A * 5/1943 Bigelow ..... 15/227
4,617,694 A * 10/1986 Bori ..... 15/167.1
D290,426 S * 6/1987 Courney ..... D4/103
4,679,274 A 7/1987 Friedman
5,026,541 A * 6/1991 Lanier ..... 424/61
5,068,941 A 12/1991 Dunn
5,234,142 A * 8/1993 Loewen et al. ..... 223/101
5,636,405 A 6/1997 Stone et al.
5,765,252 A * 6/1998 Carr ..... 15/104.94
5,875,513 A * 3/1999 Reinold ..... 15/227
5,906,546 A * 5/1999 Albert ..... 473/61
6,105,587 A 8/2000 Dunn
6,112,356 A * 9/2000 Hashey ..... 15/104.94
6,116,252 A * 9/2000 Stelmach ..... 132/309
6,145,128 A * 11/2000 Suzuki ..... 2/21

* cited by examiner

*Primary Examiner*—Terrence R. Till
(74) *Attorney, Agent, or Firm*—Randal D. Homburg

(57) ABSTRACT

The invention is a safety fingertip toothbrush for use by persons not desiring a full length toothbrush for space conservation reasons, but still desiring their regular oral hygiene practice using a toothbrush. The safety fingertip toothbrush is also a practical solution to safety hazards presented in penal institutions, where conventional toothbrushes with hard handles can pose a risk of being converted to lethal assault weapons. The safety fingertip toothbrush has no handle, but it includes a plurality of bristles embedded in a brush head, the brush head having a depression in one end to accept the fingertip of a finger and an elastic band connected to a thumb ring within which the thumb is placed, allowing for the user to brush their teeth and other mouth tissue using the fingers as the brush handle.

2 Claims, 2 Drawing Sheets

SAFETY FINGERTIP TOOTHBRUSH

CROSS REFERENCE TO RELATED APPLICATIONS

None

I. BACKGROUND OF THE INVENTION

1. Field of Invention

The invention is a safety fingertip toothbrush for use by persons not desiring a full length toothbrush for space conservation reasons, but still desiring their regular oral hygiene practice using a toothbrush. The safety fingertip toothbrush is also a practical solution to safety hazards presented in penal institutions, where conventional toothbrushes with hard handles can pose a risk of being converted to lethal assault weapons. The safety fingertip toothbrush has no handle, but it includes a plurality of bristles embedded in a brush head, the brush head having a depression in one end to accept the fingertip of a finger and an elastic band connected to a thumb ring within which the thumb is placed, allowing for the user to brush their teeth and other mouth tissue using the fingers as the brush handle.

2. Description of Prior Art

The following United States patents were discovered and are disclosed within this application for utility patent. All relate to fingertip toothbrushes. The first three patents disclosed indicate a toothbrush where a finger is inserted into the device, bristles of the device positioned on the fingertip, with the sheath or bristle containing surface made of an elastomeric material, worn on the finger similar to a condom. See, U.S. Pat. No. 6,105,587 to Dunn, 5,068,941 to Dunn and 5,875,513 to Reinold. The two patents to Dunn include a fold-back sheath to protect the bristle area from contamination. Neither of these have a thumb loop to stabilize the device between two digits. The Reinold patent includes a stabilizer, but it is an at least partially resilient handle that extends into the palm of the hand. It is not a thumb loop, and could, in fact, defeat the safety objectives of the current invention converting to a weapon that could penetrate the skin to cause injury.

In U.S. Pat. No. 4,679,274 to Freidman, a brush is disclosed having a clamp mounted to the forefinger of the user, with a stem and bristle area extending beyond the finger tip. However, it does not have a loop to contain a thumb of the user for added stabilization. U.S. Pat. No. 5,636,405 to Stone, is disclosed as a hollow tapered cylindrical shaft with a plurality of bristle rows, intended to insert on a finger. This patent, which defies all patent propriety in its wrongful use of numbering of its elements, apparently has expansion sectors (1), bristle like projections (2), and thinner sectors (unknown number, either 3, 4 or 5). A digit could be placed in each open end of this device, but that is not disclosed, and the opposite end opening cannot be consider the equivalent of a resilient thumb loop.

II. SUMMARY OF THE INVENTION

Certain situations arise when a full length toothbrush cannot be stored or transported. It might be impractical to attempt transport of a full length toothbrush in a pocket book, pocket or billfold. In addition, the prison population over the years has continually found ways and means to create weapons used for assault and injury from otherwise harmless items including toothbrush handles sharpened into penetrating probes used for stabbing, sharpened broom and mop handles and even combs and brushes for hair. In order to reduce these identified potential prison security problems, the current invention was conceived to eliminate one of these problems and also provide a stable instrument for oral hygiene.

The primary objective of the invention is to provide a fingertip toothbrush that cannot be converted to a weapon. A second objective is to provide the toothbrush in a compact format to carry in a pocket or other small area, yet providing a stable instrument to conduct oral hygiene using a finger and a thumb for stability during use.

III. DESCRIPTION OF THE DRAWINGS

The following drawings are submitted with this utility patent application.

FIG. 5 is a perspective view of the invention on a hand as used.

IV. DESCRIPTION OF THE PREFERRED EMBODIMENT

Figure 1:
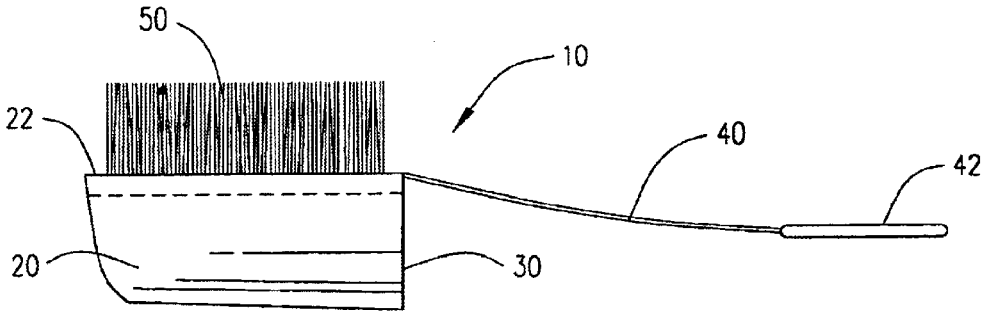
FIG. 1 is a side view of the toothbrush.
Figure 2:
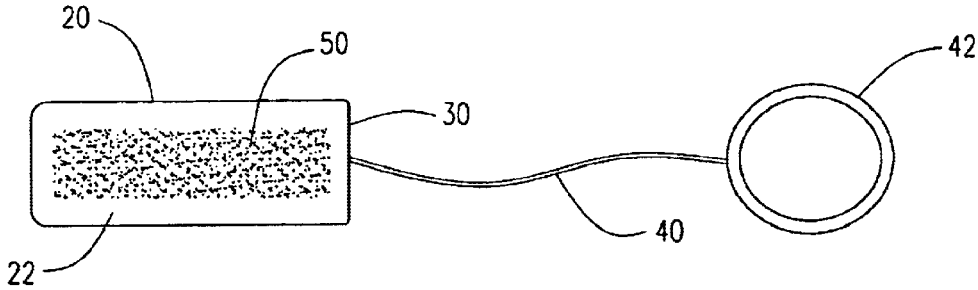
FIG. 2 is a top view of the toothbrush.
Figure 3:
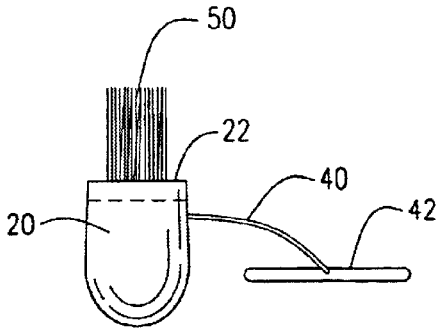
FIG. 3 is an end view of the invention.
Figure 4:
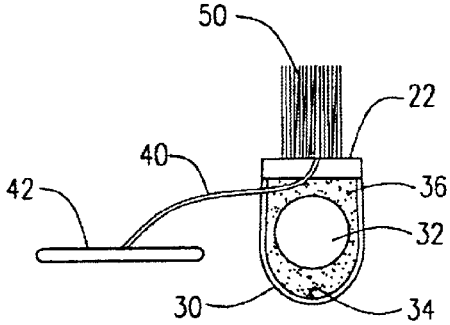
FIG. 4 is another end view of the invention.
Figure 3:
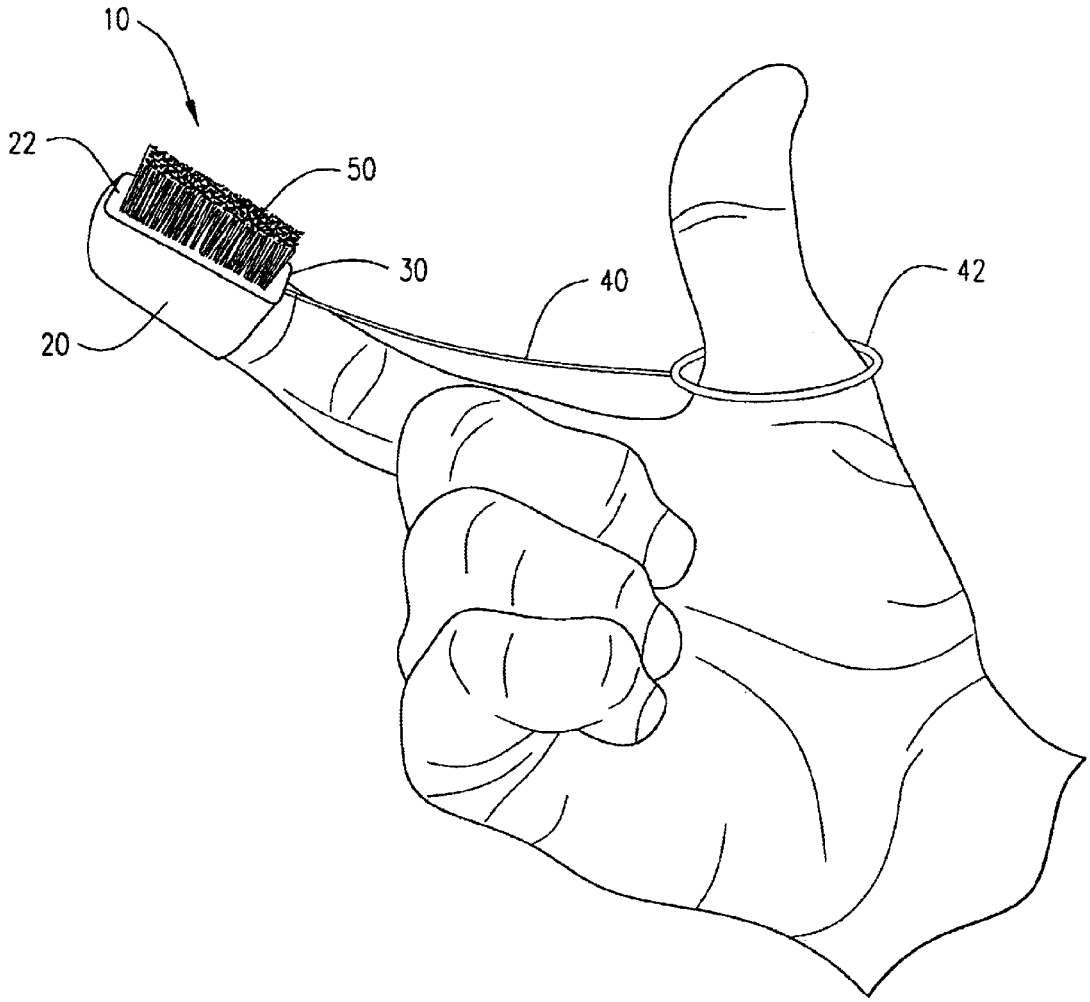

The invention is a handless compact safety toothbrush 10, as shown in FIGS. 1–5 of the drawings, placed on a finger and held by the thumb, permitting oral hygiene and tooth care without a conventional toothbrush having a rigid extended handle, the safety toothbrush comprising a cylindrical base member 20 having a slot end 30 providing a concave finger slot 32, an elastic band 40 attaching to a resilient thumb loop 42 and a surface 22 having a plurality rows of bristles 50, the cylindrical base member 20 having an inner cavity 34 being lined with a soft compressible foam material 36, shown in FIG. 4.

It is preferred that the entire toothbrush 10 be comprised of a plastic material which can be sanitized with hot water periodically and also withstand exposure to water without damage to the toothbrush. The overall size of the toothbrush 10 should be no longer that a comfortable distance between the space of a thumb and bent finger, and no wider than would comfortably fit between the cheek and gums of a user or between upper and lower teeth in an open mouth.

Use of the toothbrush 10 requires the placement of the thumb of the user in the thumb loop 42, placement of an adjacent finger in the finger slot 32, shown in FIG. 5, and application of the tooth cleansing product on the bristles 50. The toothbrush is urged onto the user's finger by the tension provided by the elastic band 40 between the slot end 30 and the thumb loop 42. The user may then conduct the oral hygiene on his teeth and gums, rinse the post-hygiene waste from the toothbrush 10, and hang the toothbrush 10 from the thumb loop 42 to air dry. The thumb loop 42 and the elastic band 40 may be disposed within the finger slot 32 for compact transport and storage.

While the invention has been particularly shown and described with reference to a preferred embodiment thereof, it will be understood by those skilled in the art that changes in form and detail may be made therein without departing from the spirit and scope of the invention.

What is claimed is:

1. A handless safety toothbrush placed on a finger and held by the thumb, permitting oral hygiene and tooth care without a conventional toothbrush having an extended rigid handle, the safety toothbrush comprising:

a cylindrical base member having a slot end providing a concave finger slot, an elastic band attaching to a resilient thumb loop, a surface having a plurality rows of bristles, and an inner cavity lined with a soft compressible foam material, wherein the finger is placed within the inner cavity through the concave finger slot and the thumb loop is placed on the thumb, the elastic band urging the toothbrush onto the finger by tension between the toothbrush and the thumb loop.

2. The toothbrush, as disclosed in claim 1, wherein the entire toothbrush is made of a thermoplastic material which can be exposed to and sanitized with hot water without damage to the toothbrush.

* * * * *